US007071670B1

(12) United States Patent
Hidri et al.

(10) Patent No.: US 7,071,670 B1
(45) Date of Patent: Jul. 4, 2006

(54) GENERATING REFERENCE VOLTAGES

(75) Inventors: Ols Hidri, Munich (DE); Christopher A. Menkus, Munich (DE)

(73) Assignee: National Semiconductor Corporation, Santa Clara, CA (US)

( * ) Notice: Subject to any disclaimer, the term of this patent is extended or adjusted under 35 U.S.C. 154(b) by 232 days.

(21) Appl. No.: 10/695,921

(22) Filed: Oct. 28, 2003

(51) Int. Cl.
*G05F 3/16* (2006.01)

(52) U.S. Cl. ..... 323/313

(58) Field of Classification Search ..... 323/313, 323/314, 315, 316; 327/513, 539
See application file for complete search history.

(56) References Cited

U.S. PATENT DOCUMENTS

| | | | | |
|---|---|---|---|---|
| 5,936,392 | A * | 8/1999 | Taylor | 323/315 |
| 6,225,856 | B1 * | 5/2001 | Toth | 327/539 |
| 6,232,829 | B1 * | 5/2001 | Dow | 327/539 |
| 6,501,256 | B1 * | 12/2002 | Jaussi et al. | 323/315 |
| 6,507,180 | B1 * | 1/2003 | Eguchi | 323/314 |

OTHER PUBLICATIONS

Buck et al., "A CMOS Bandgap Reference Without Resistors", IEEE Journal of Solid-State Circuits, vol. 37, No. 1, pp. 81-83, Jan. 2002.

* cited by examiner

*Primary Examiner*—Adolf Berhane
(74) *Attorney, Agent, or Firm*—John W. Branch; Darby & Darby PC

(57) ABSTRACT

A reference voltage is generated between a first node and a second node. A resistive element and a junction device are coupled in series between the first node and the second node. The junction device includes a junction between dissimilar materials, and has a negative temperature coefficient. First and second current sources route respective first and second bias currents to the resistive element and to the junction device. Routing is such that a resulting first branch current through the resistive element is generally not equal to a resulting second branch current through the junction device. The second bias current depends less on manufacturing process variation than the first bias current, and the second branch current can contain more of it, for less dependence on process. The second bias current can be generated by a source that uses the generated reference voltage as a reference.

18 Claims, 7 Drawing Sheets

GENERATING REFERENCE VOLTAGES

FIELD OF THE INVENTION

The present invention is related to the field of electrical circuits, and more specifically to devices, circuits and methods for generating reference voltages.

BACKGROUND

As electrical circuits become optimized, margins become increasingly stricter. These are margins of variations in both the mass manufacturing of the devices (to ensure uniformity), and also in their operation.

One type of margin that is affected is variations in the actual values of reference voltages. These are voltages that the circuit treats as having a known and substantially constant value. These reference voltages can be affected by variations in operating temperature of the circuit. They can also be affected by variations in manufacturing, since individual components may be manufactured with values different than designed.

BRIEF DESCRIPTION OF THE DRAWINGS

The invention will become more readily apparent from the following Detailed Description, which proceeds with reference to the Drawings, in which.

DETAILED DESCRIPTION

Figure 1:
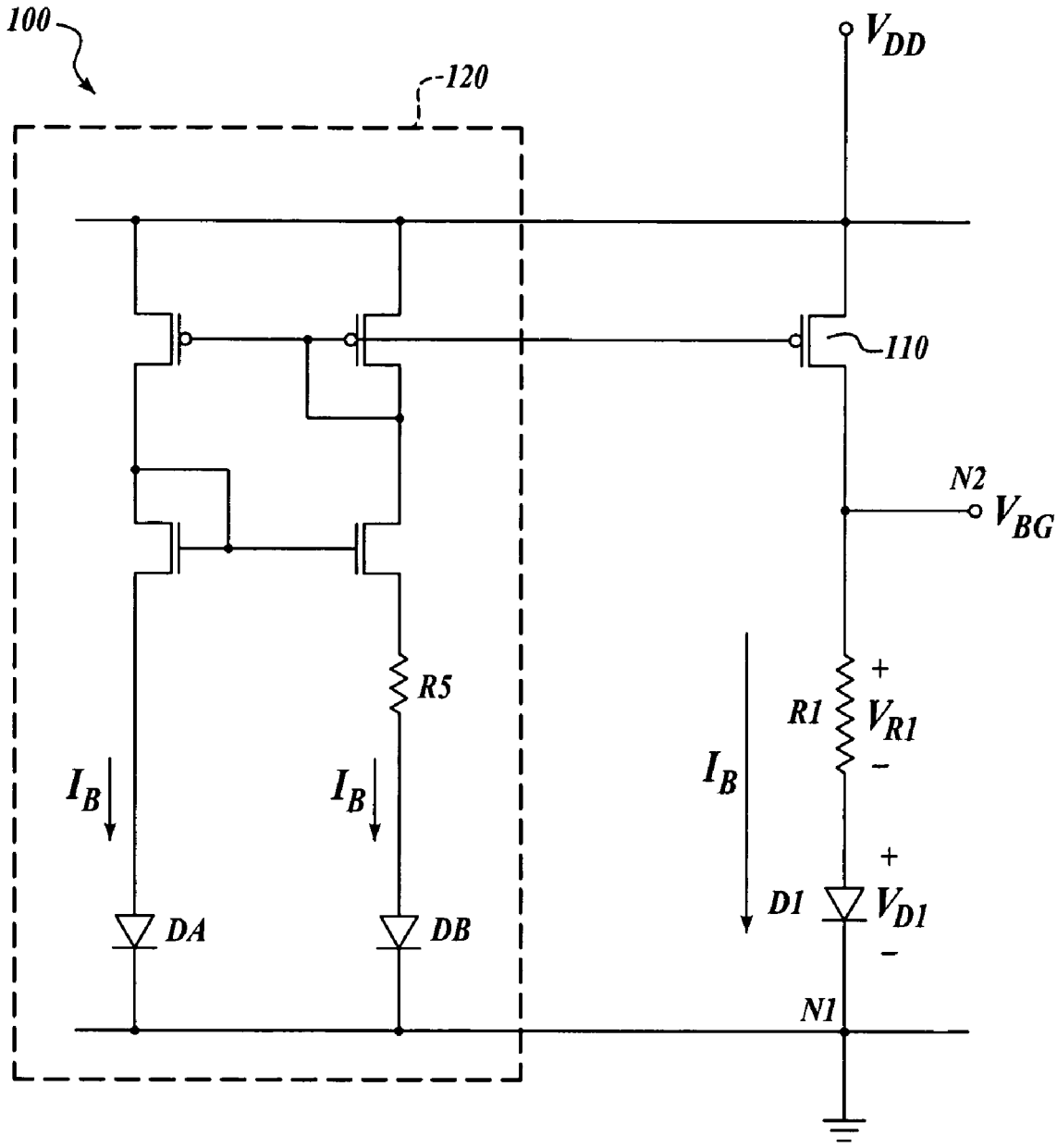
FIG. 1 is a schematic of a circuit for generating a reference voltage.

The present invention is now described. While it is disclosed in its preferred form, the specific embodiments of the invention as disclosed and illustrated in the drawings are not to be considered in a limiting sense. Rather, these embodiments are provided so that this disclosure will be thorough and complete, and will fully convey the scope of the invention to those skilled in the art. Indeed, it should be readily apparent in view of the present description that the invention may be modified in numerous ways. Among other things, the present invention may be embodied as devices, methods, software, and so on. Accordingly, the present invention may take the form of an entirely hardware embodiment, an entirely software embodiment or an embodiment combining software and hardware aspects. The following detailed description is, therefore, not to be taken in a limiting sense.

Throughout the specification, the meaning of "a," "an," and "the" may also include plural references. The meaning of "in" includes "in" and "on."

Generally, the present invention provides devices, circuits and methods for generating reference voltages. Briefly, a reference voltage is generated between a first node and a second node. A resistive element and a junction device are coupled in series between the first node and the second node. The junction device includes a junction between dissimilar materials, and has a negative temperature coefficient. First and second current sources route respective first and second bias currents to the resistive element and to the junction device. Routing is such that a resulting first branch current through the resistive element is generally not equal to a resulting second branch current through the junction device. The second branch current depends less on manufacturing process variation than the first.

FIG. 1 is a schematic of circuit 100, which generates reference voltage $V_{BG}$ between nodes N1 and N2. Node N1 is coupled to the ground, and reference voltage $V_{BG}$ is therefore generated at node N2.

Circuit 100 includes resistor R1 and diode D1 coupled in series between nodes N1 and N2. Further, circuit 100 includes transistor 110.

In operation, transistor 110 operates as a current source, and transmits bias current $I_B$ through resistor R1 and diode D1. As bias current $I_B$ passes through resistor R1, it causes voltage drop $V_{R1}$. As bias current $I_B$ then passes through diode D1, it causes voltage drop $V_{D1}$. Accordingly, circuit 100 forms reference voltage $V_{BG}$ at node N2 substantially as a sum of voltage drops $V_{R1}$ and $V_{D1}$.

Circuit 100 performs temperature compensation to some extent, in generating reference voltage $V_{BG}$. That is because, as temperature changes, voltages $V_{R1}$ and $V_{D1}$ also change, but in directions opposite to each other. In other words, when temperature increases, voltage $V_{R1}$ increases but voltage $V_{D1}$ decreases. Therefore their sum $V_{BG}$ varies much less as temperature changes.

Bias current $I_B$ may be generated and controlled in a number of ways. In circuit 100, support circuitry 120 is provided. Support circuitry 120 includes a current mirror made from two PMOS transistors. The current mirror controls transistor 110. Transistor 110 can be sized such that it replicates current $I_B$ flowing from supply node $V_{DD}$ to ground in the current mirror.

Support circuitry 120 terminates in diodes DA, DB, which can be implemented by the emitter-base junctions of respective transistors. These transistors have differently sized emitter areas EADA, EADB, respectively. Accordingly, a ratio is defined m=1n(EADB/EADA).

In support circuitry 120, bias current $I_B$ is controlled by set resistor RS. A difference in emitter-base voltages is applied across resistor RS, which therefore determines bias current $I_B$. Ultimately, bias current $I_B$ is substantially equal to $mV_T/R_S$, where $V_T$ is the thermal voltage, m is derived from the emitter area ratio defined above, and $R_S$ is the value of resistor RS. Therefore, in the implementation of circuit 100, voltage drop $V_{R1}$ across R1 is given by $I_BR_1$, or $mV_TR_1/R_S$, where $R_1$ is the resistance value of resistor R1.

In circuit 100, voltage drop $V_{D1}$ across diode D1 can change too much depending on changes in the value $R_S$ of set resistor RS. That is because the base emitter voltage $V_{D1}$ across diode D1 depends on the value of bias current $I_B$, which in turn is proportional to resistance $R_S$, which is subject to variation in manufacturing process. These errors are very large for CMOS processes, and cannot be controlled by layout considerations. Accordingly, a variation in resistance $R_S$ contributes to a variation of voltage drop $V_{D1}$, logarithmically.

Figure 2:
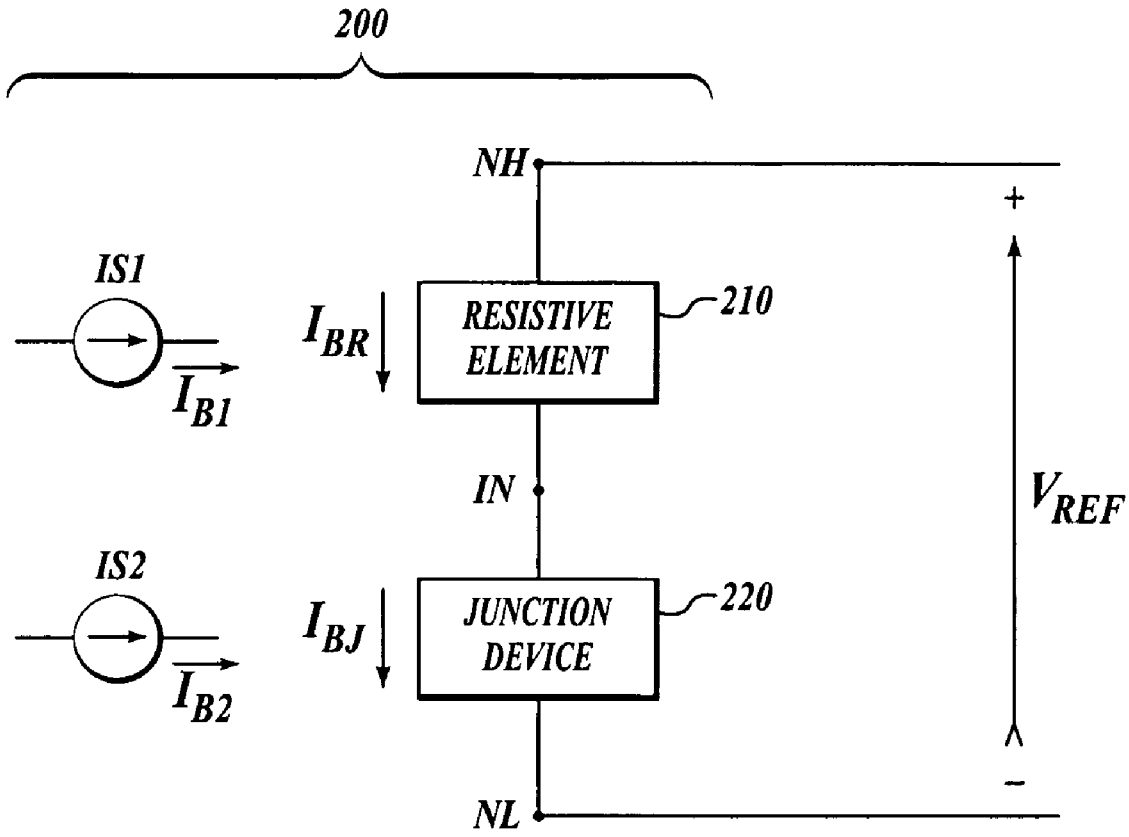
FIG. 2 is a diagram showing some components of a circuit for generating a reference voltage.

FIG. 2 is a diagram showing group 200 of some components of a circuit for generating a reference voltage according to the invention. Group 200 is thus not a complete circuit.

In general, the invention produces reference voltage $V_{REF}$ between first node NL and second node NH. Resistive element 210 and junction device 220 are coupled in series between first node NL and second node NH. Resistive element 210 can be made from a single resistor, or a combination that includes at least one resistor, etc. Junction device 220 includes a junction, such as a junction between dissimilar materials. Junction device 220 has a negative temperature coefficient, which means that as temperature increases, a voltage across it decreases. In some embodiments, junction device 220 is implemented by a diode, where the junction is between p-type and n-type semiconductor material. In some embodiments, the junction device is implemented by a transistor. In some of those instances, the biased junction is that between an emitter and a base of the transistor. The collector may be coupled, for example, to the base.

A first current source IS1 and a second current source IS2 generate and control first bias current $I_{B1}$ and second bias current $I_{B2}$. First and second bias currents $I_{B1}$ and $I_{B2}$ are routed to resistive element 210 and to junction device 220. Routing is such that resulting first branch current $I_{BR}$ through resistive element 210 is generally not equal to resulting second branch current $I_{BJ}$ through junction device 220.

The inequality between first branch current $I_{BR}$ and second branch current $I_{BJ}$ is accomplished in any number of ways. One of them includes having at least one of current sources IS1, IS2 tap into intermediate node IN, defined between resistive element 210 and junction device 220.

Figure 3:
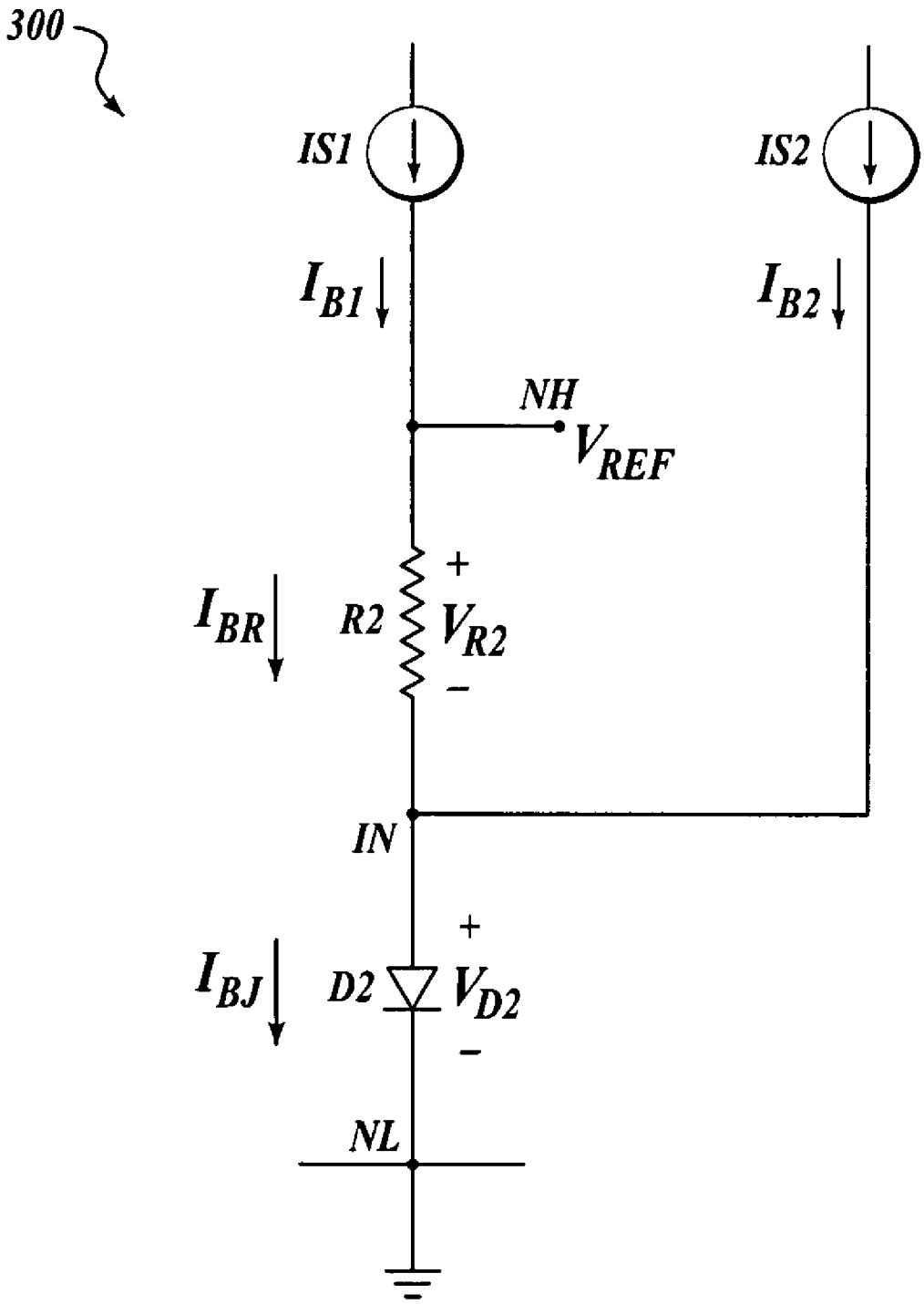
FIG. 3 is a schematic of a circuit for generating a reference voltage.

FIG. 3 shows circuit 300 according to an embodiment of the invention. First node NL is coupled to the ground, so reference voltage $V_{REF}$ is produced on second node NH.

A resistive element is made from resistor R2. A junction device is made from diode D2, also as per the above. First current source IS1 routes first bias current $I_{B1}$ through resistor R2. This way it generates voltage drop $V_{R2}$ between nodes IN and NH, which is also known as resistive voltage drop. In circuit 300, first bias current $I_{B1}$ continues through node IN, and then through diode D2. Second current source IS2 transmits second bias current $I_{B2}$ through diode D2.

Importantly, second bias current $I_{B2}$ is not transmitted through resistor R2. This may be accomplished by having second current source IS2 transmit second bias current $I_{B2}$ directly into intermediate node IN. The additional second bias current $I_{B2}$ then goes through diode D2, and then to node NL, without passing through resistor R2.

The result then, is that through diode D2, there passes second branch current $I_{BJ}$ that is different from first branch current $I_{BR}$. In the embodiment of FIG. 3, second branch current $I_{BJ}$ is made by combining first bias current $I_{B1}$ with the second bias current $I_{B2}$. Other embodiments are also possible in forming second branch current $I_{BJ}$, as seen below.

Second branch current $I_{BJ}$ causes a voltage drop $V_{D2}$ between nodes NL and IN. Voltage drop $V_{D2}$ is also known as junction voltage drop, because it is formed across diode D2 that has a junction. In this case, junction voltage drop $V_{D2}$ is a p-n junction voltage drop.

Accordingly, reference voltage $V_{REF}$ generated by circuit 300 equals substantially the sum of $V_{R2}$ and $V_{D2}$. These, however, are generated by branch currents $I_{BR}$, $I_{BJ}$ that are generally different.

In general, second current source IS2 is implemented so that second bias current $I_{B2}$ is less dependent on manufacturing process variation than first bias current $I_{B1}$. This can be accomplished in a number of ways. For example, a reference current can be brought in from outside the chip, and be controlled that way. Another example is discussed later in this document. Therefore, first bias current $I_{B1}$ has a different dependence on process variation than second bias current $I_{B2}$.

Accordingly, also first branch current $I_{BR}$ has a dependence on process variation that is different than that of second branch current $I_{BJ}$. This is because of the participation of second bias current $I_{B2}$, which has less such dependence.

The higher independence on process variation of second branch current $I_{BJ}$ can be enhanced in a number of ways. For example, second bias current $I_{B2}$ can be designed to be larger than first bias current $I_{B1}$, for example 3 times larger, or 10 times, or even more. This way, the dependence contributed by $I_{B1}$ becomes less significant compared to the relative independence contributed by $I_{B2}$. Another way is to substantially remove first bias current $I_{B1}$, as is described below.

Figure 4:
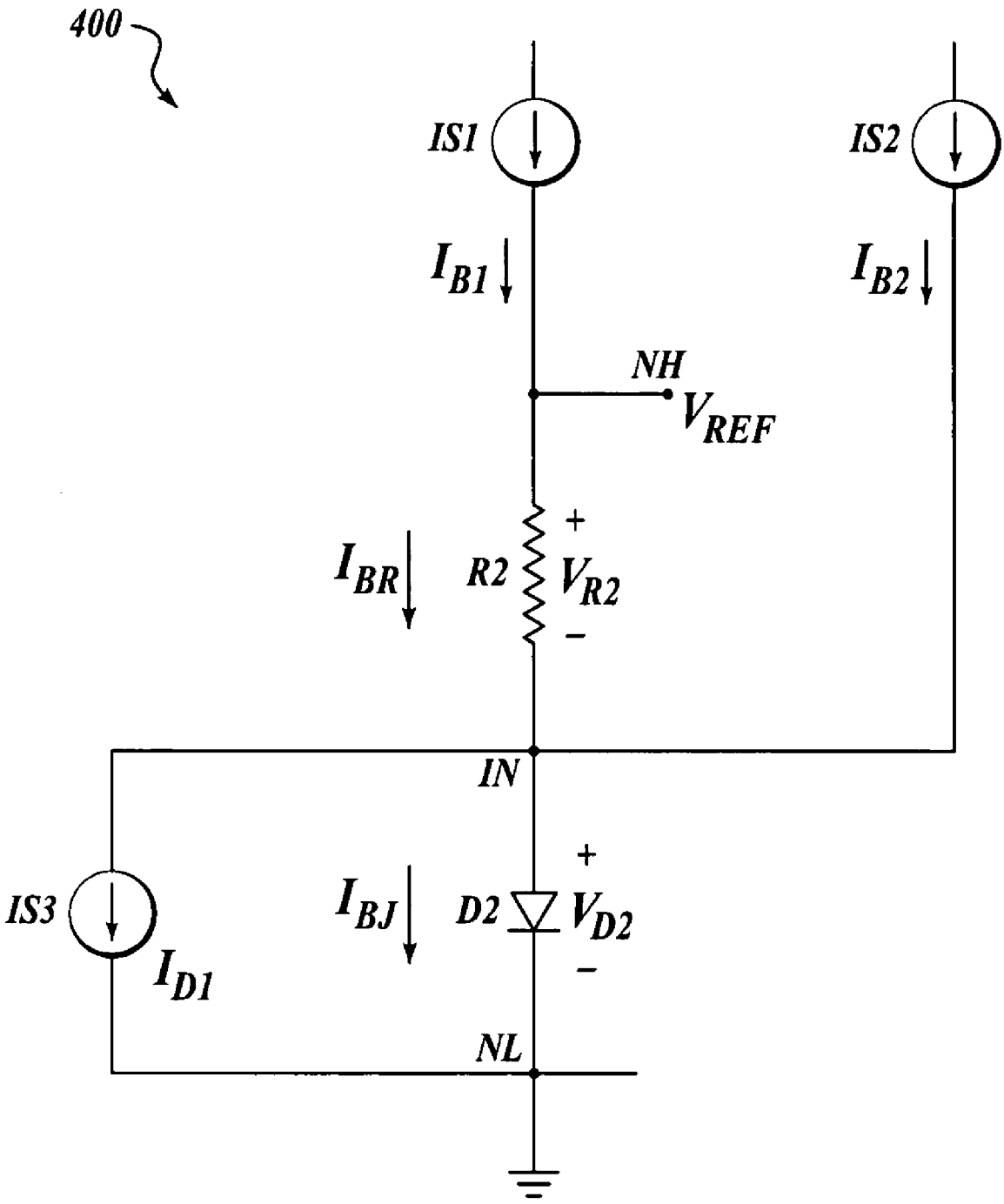
FIG. 4 is a schematic of yet another circuit for generating a reference voltage.

FIG. 4 shows a circuit 400 that includes many of the elements of circuit 300 of FIG. 3. Circuit 400 further includes third current source IS3 that extracts drained current $I_{D1}$ from intermediate node IN.

In one embodiment, drained current $I_{D1}$ is set to be approximately equal to first bias current $I_{B1}$, and to have approximately the same manufacturing process variation characteristic as first bias current $I_{B1}$. This way, what is left in second branch current $I_{BJ}$ is substantially second bias current $I_{B2}$, which is thus less dependent on manufacturing process variation.

Figure 5:
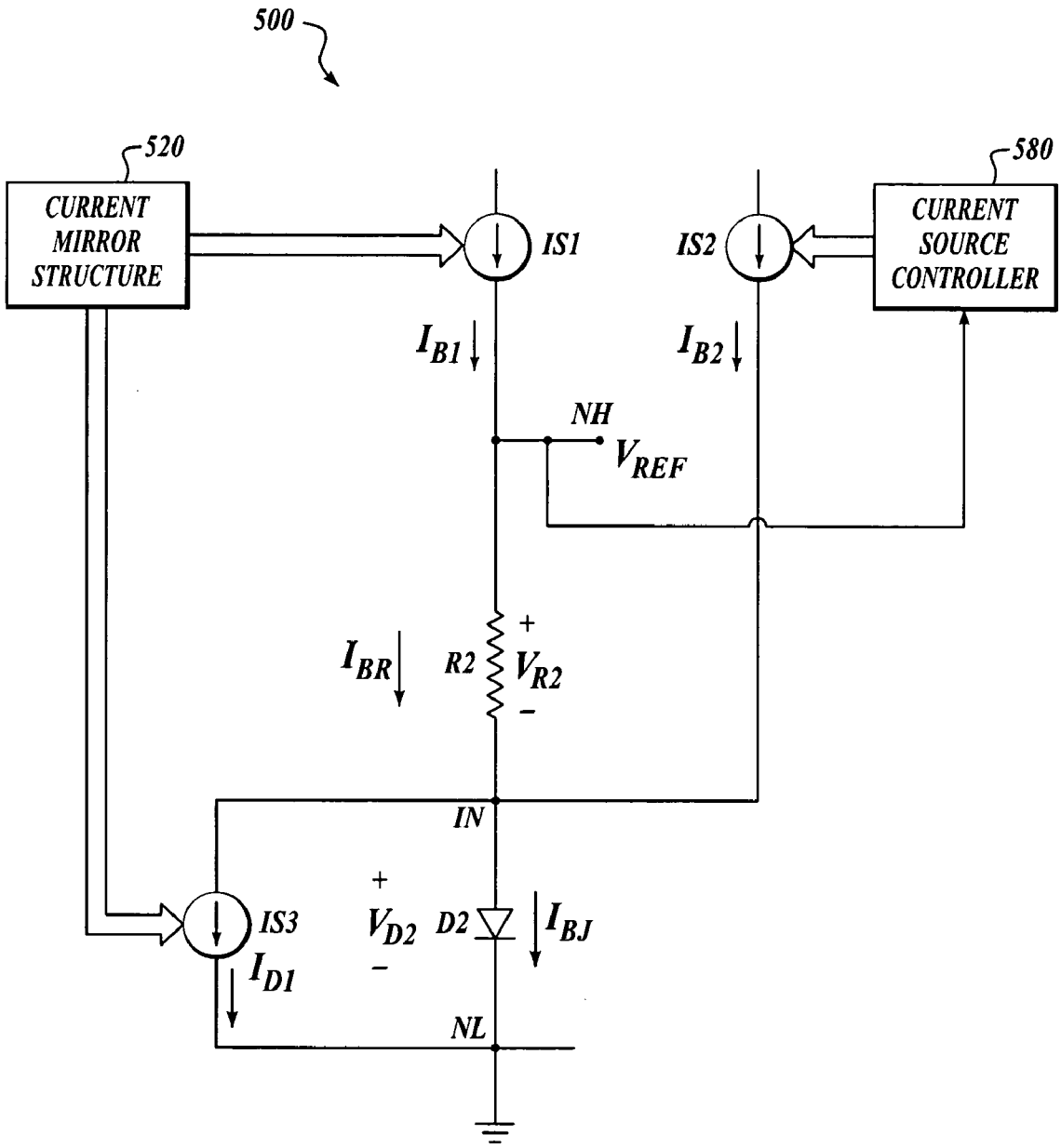
FIG. 5 is a schematic of a circuit showing a possible implementation of the circuit of FIG. 4.

FIG. 5 shows a circuit 500 for implementing some of the elements of circuit 400 of FIG. 4. In circuit 500, current mirror structure 520 controls concurrently first current source IS1 and third current source IS3. This way, current mirror structure 520 ensures that drained current $I_{D1}$ remains approximately equal to first bias current $I_{B1}$, notwithstanding changes in manufacturing process variation. This permits the more manufacturing process variation-stable second bias current $I_{B2}$ to dominate second branch current $I_{BJ}$. Of course, in its implementation, current mirror structure 520 is only a part of a broader support circuitry, which is not shown in FIG. 5.

In circuit 500, current source controller 580 controls second current source IS2. This in turn controls the value of second bias current $I_{B2}$. In the embodiment of circuit 500, current source controller 580 is advantageously controlled by the generated reference voltage $V_{REF}$. Control may be direct, or reference voltage $V_{REF}$ may be first amplified, or divided to produce a control voltage, etc. Or another voltage may be used that is deemed to be accurate, etc.

In circuit 500, a feedback loop may be defined, since current source controller 580 is controlled by reference voltage $V_{REF}$, and in turn controls second current source IS2. In fact, the feedback loop has the potential of being positive. To avoid instability, current source controller 580 is chosen so that it controls second current source IS2 in such a way that the feedback loop has an open loop gain of less than one.

In addition, circuit 500 may be implemented without third current source IS3. If that is so, then it may be advisable to adjust accordingly current source controller 580, and thus also second bias current $I_{B2}$.

Figure 6:
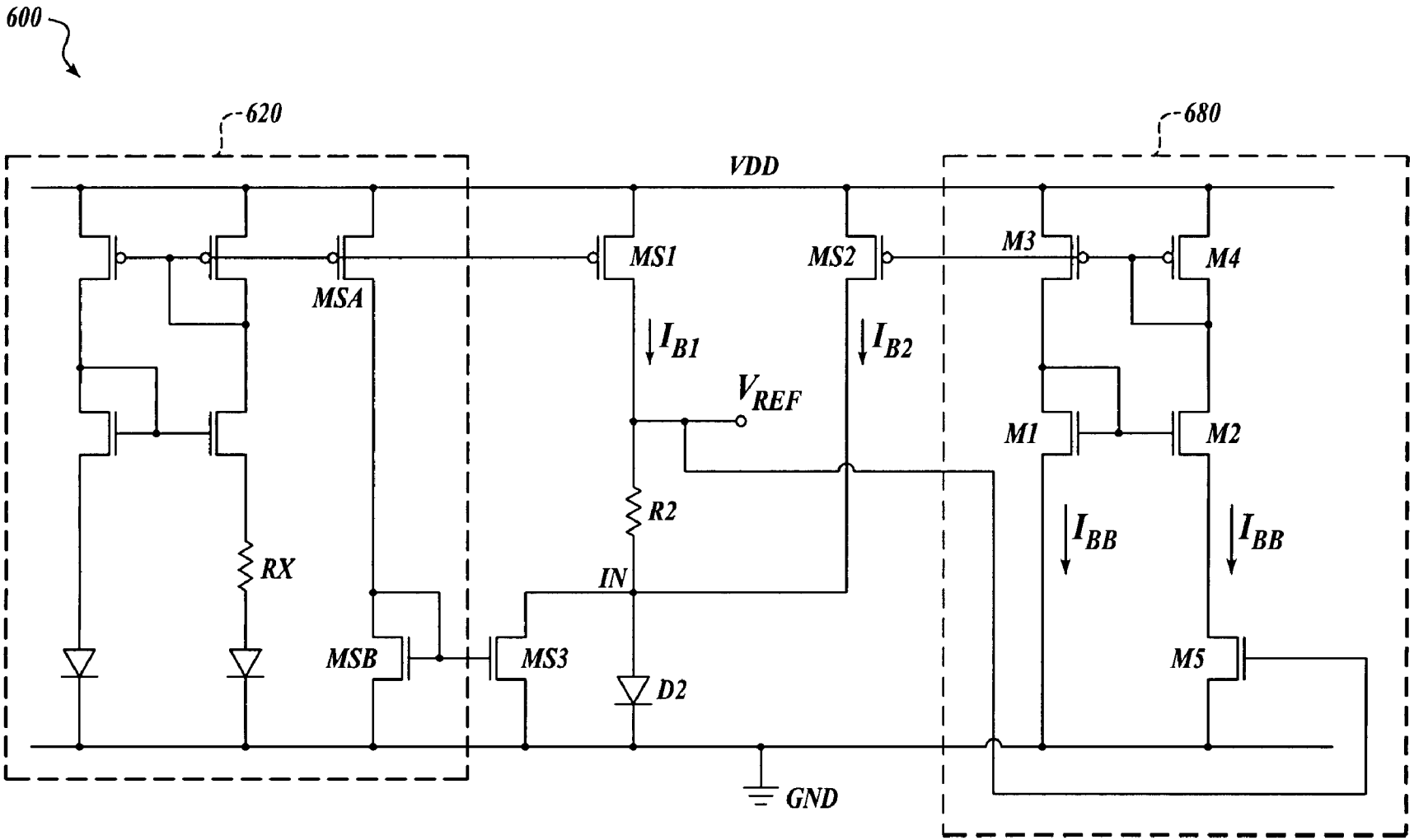
FIG. 6 is a schematic of a circuit showing a possible implementation of the circuit of FIG. 5.

FIG. 6 shows a circuit 600 for one implementation of circuit 500 of FIG. 5. In circuit 600, current sources IS1, IS2, IS3 are implemented by transistors MS1, MS2, MS3 respectively.

Support circuitry 620 is used to control transistors MS1, MS3. Support circuitry 620 is a particular full implementation of current mirror structure 520 of circuit 500. Specifically, support circuitry 620 includes a current mirror, of the type used in FIG. 1. Set resistor RX is used to set the current through transistor MS1. In addition, transistors MSA, MSB may be used to drive transistor MS3, and with the same current—and also the same dependence on process variation—as in the current through transistor MS1.

Further, current source controller 680 controls transistor MS2. Current source controller 680 is a particular implementation of current source controller 580 of circuit 500. Current source controller 680 includes four transistors M1, M2, M3 and M4, of which transistors M3 and M4 are arranged in a current mirror configuration. A fifth transistor M5 has a gate that senses reference voltage $V_{REF}$. These are arranged to implement a self-biased circuit, and using a channel resistance of NMOS transistor M5 in the triode region.

In one embodiment, transistors M1, M2, M5 are n-type, while transistors M3, M4, MS2 are p-type. Transistor M2 has K times the aspect ratio (Width/Length) of transistor M1, and transistor M5 has n times the aspect ratio (Width/Length) of transistor M1. Transistors M3 and M4 have the same aspect ratio, while transistor MS2 has f times the aspect ratio of transistor M3 or M4.

The current mirror of FIG. 6 results in substantially similar currents $I_{BB}$ flowing from transistor M3 to transistor M1, and from transistor M4 to transistor M2. Accordingly, transistor MS2 is operated as a current source to output current $I_{B2}$ substantially equal to $f*I_{BB}$.

It is noteworthy that operation of current source controller 680 does not depend on a resistance value of a resistor (such as set resistor RX) being constant, but on that of the channel an NMOS transistor (transistor M5). This results in generating a current that is very stable with variations in manufacturing process. This means, low variation with process corners, which is for a number of reasons. For example, in one embodiment, the overdrive of transistor M5 used in triode region is about 1V, while this process has a typical threshold voltage of 200 mV. Also, the gate voltage of the NMOS used in triode region is a stable voltage—it is the generated reference voltage $V_{REF}$ itself. Additionally, the geometric effects are well controllable by proper sizing and layout. Finally, the variation of the gate oxide and mobility are not large.

Alternately, circuit 600 may be implemented without third current source IS3. In that instance, transistors MS3, MSA, and MSB would be omitted. And it might be desirable to adjust current source controller 680, as per the above.

Figure 7:
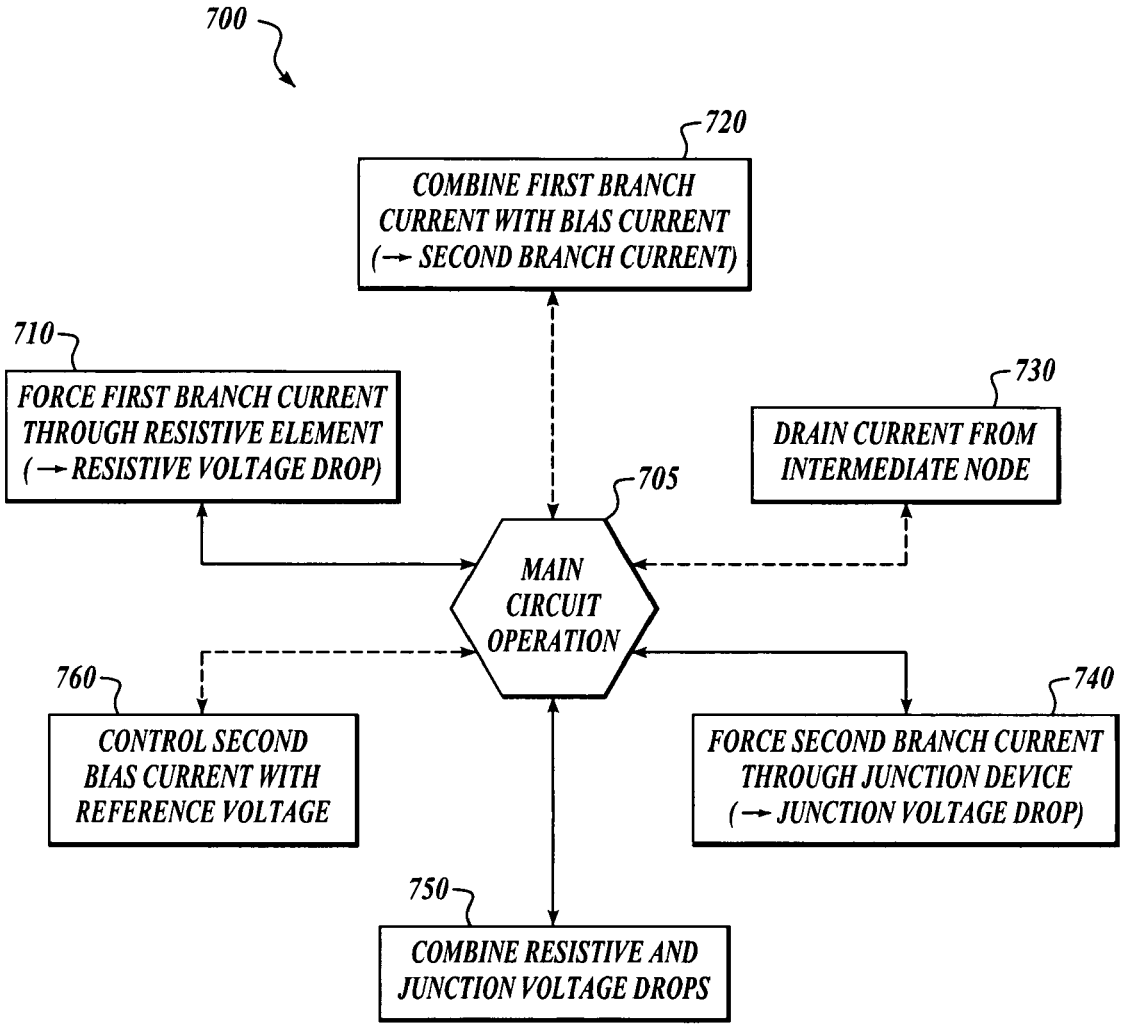
FIG. 7 is a diagram illustrating a method according to an embodiment of the present invention.

Referring now to FIG. 7, diagram 700 illustrates a method according to an embodiment of the invention. The method of diagram 700 may also be practiced by different embodiments of the invention, including but not limited to circuits 300, 400, 500, and 600.

Block 705 represents a main circuit operation. Block 705 cooperates with, and may take place concurrently with other blocks as shown with arrows. Dashed arrows indicate optional operations. Main circuit operation 705 is for generating a reference voltage $V_{REF}$. Reference voltage $V_{REF}$ may be generated between a first node and a second node.

At block 710, a first branch current is forced through a resistive element. The resistive element may be coupled between an intermediate node and the second node. The first branch current thus creates a voltage drop across the resistive element, which is also known as resistive voltage drop.

At optional block 720, the first branch current is optionally combined with a bias current, to form a second branch current. The bias current may be derived from a second current source. Combining may take place by jointly feeding into a node, such as intermediate node IN.

At optional block 730, current is drained from intermediate node IN. Draining may be part of the combining of block 720. In some embodiments, the drained current approximately equals the first bias current. In those cases, the resulting second branch current equals the bias current that was added at block 720.

At block 740, a second branch current is forced through a junction device. The second branch current may be formed as per optional block 720, optionally as also modified by block 730, or otherwise. The junction device includes a junction, such as a junction between dissimilar materials, and has a negative temperature coefficient. The junction device may be coupled between the intermediate node and the first node. The second branch current across the junction device creates a voltage drop across it, which is also known as junction voltage drop.

At block 750, the resistive voltage drop is added to the junction voltage drop. The addition generates a reference voltage. Adding may be by combining them along a node, such as intermediate node IN.

At block 760, the second bias current is controlled by the reference voltage generated at block 740. This may take place by also using a current controller that in turn receives the reference voltage, etc.

Numerous details have been set forth in this description, which is to be taken as a whole, to provide a more thorough understanding of the invention. In other instances, well-known features have not been described in detail, so as to not obscure unnecessarily the invention.

The invention includes combinations and subcombinations of the various elements, features, functions and/or properties disclosed herein. The following claims define certain combinations and subcombinations, which are regarded as novel and non-obvious. Additional claims for other combinations and subcombinations of features, functions, elements and/or properties may be presented in this or a related document.

The invention claimed is:

1. A circuit for producing a reference voltage between a first node and a second node, comprising:

a resistive element and a junction device coupled in series between the first node and the second node, wherein the junction device includes a junction and has a negative temperature coefficient;

a first and a second current sources to route respectively a first and a second bias currents to the resistive element and to the junction device such that a resulting first branch current through the resistive element is unequal to a resulting second branch current through the junction device, wherein the first current source is adapted to transmit the first bias current through the resistive element, and wherein the second current source is adapted to transmit the second bias current through the junction device for biasing the junction, without transmitting the second bias current through the resistive element; and wherein the first bias current reaches the intermediate node after the resistive element and before the junction device; and a third current source to extract a drained current from the intermediate node.

2. The circuit of claim 1, wherein the first bias current has a different manufacturing process variation dependence than the second bias current.

3. The circuit of claim 1, wherein the second bias current is larger than the first bias current.

4. The circuit of claim 1, wherein the drained current approximately equals the first bias current, and has approximately the same manufacturing process variation dependence as the first bias current.

5. The circuit of claim 1, further comprising:

a current mirror structure for controlling concurrently the first current source and the third current source.

6. The circuit of claim 1, further comprising:

a current source controller to control the second current source, wherein the current source controller is controlled by the reference voltage.

7. The circuit of claim 6, wherein a feedback loop is defined from the current source controller being controlled by the control voltage and in turn controlling the second current source, and the current source controller controls the second current source such that the feedback loop has an open loop gain of less than one.

8. A device for producing a reference voltage between a first node and a second node, comprising:

a first circuit that forces a first branch current through a resistive element to generate a resistive voltage drop between the second node and an intermediate node;

a second circuit that forces a second branch current through a junction device that includes a junction and has a negative temperature coefficient to generate a junction voltage drop between the intermediate node and the first node, wherein the second branch current is unequal to the first branch current; and a third circuit that extracts a drained current from the intermediate node.

9. The device of claim 8, wherein the first branch current has a different manufacturing process variation dependence than the second branch current.

10. The device of claim 8, wherein the second branch current is larger than the first branch current.

11. The device of claim 8, further comprising:

a fourth circuit that enables the draining from the intermediate node a drained current that approximately equals the first branch current, and has approximately the same manufacturing process variation dependence as the first branch current.

12. A method comprising:

forcing a first branch current through a resistive element to generate a resistive voltage drop;

forcing a second branch current through a junction device that includes a junction and has a negative temperature coefficient to generate a junction voltage drop, wherein the second branch current is different from the first branch current;

adding the resistive voltage drop to the junction voltage drop to generate a reference voltage;

wherein the first branch current is arranged to transmit a first bias current through the resistive element and wherein the second branch current is arranged to transmit a second bias current through the junction device for biasing the junction, without transmitting the second bias current through the resistive element, and wherein the first bias current reaches an intermediate node after the resistive element and before the junction device; and extracting a drained current from the intermediate node with a third branch current.

13. The method of claim 12, wherein the first branch current has a different manufacturing process variation dependence than the second branch current.

14. The method of claim 12, wherein the second branch current is larger than the first branch current.

15. The method of claim 12, further comprising:

combining the first branch current with a bias current to generate the second branch current.

16. The method of claim 15, further comprising:

controlling the bias current by the reference voltage.

17. The method of claim 15, further comprising:

draining at least some of the first branch current.

18. The method of claim 17, wherein the drained current approximately equals the fist branch current, and has approximately the same manufacturing process variation dependence as the first branch current.

* * * * *

UNITED STATES PATENT AND TRADEMARK OFFICE

CERTIFICATE OF CORRECTION

PATENT NO. : 7,071,670 B1
APPLICATION NO. : 10/695921
DATED : July 4, 2006
INVENTOR(S) : Ols Hidri et al.

It is certified that error appears in the above-identified patent and that said Letters Patent is hereby corrected as shown below:

Title Page Col. 2 (Attorney, Agent or Firm), Line 2, Delete "PC" and insert -- P.C.--.

Sheet 6 or 7 (Beside Box 620), Line 1, Delete "VDD" and insert -- $V_{DD}$ --.

In the Claims:

Column 8, Line 13, In Claim 12, after "element" insert -- , --.

Column 8, Line 41, In Claim 18, delete "fist" and insert -- first --.

Signed and Sealed this

Nineteenth Day of December, 2006

JON W. DUDAS
*Director of the United States Patent and Trademark Office*